US008320806B2

(12) United States Patent
Takayanagi

(10) Patent No.: US 8,320,806 B2
(45) Date of Patent: Nov. 27, 2012

(54) IMAGE FORMING APPARATUS WITH CLEANING MEMBER

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 12/949,451

(22) Filed: Nov. 18, 2010

(65) Prior Publication Data

US 2011/0116829 A1 May 19, 2011

(30) Foreign Application Priority Data

Nov. 19, 2009 (JP) ..... 2009-264311

(51) Int. Cl.
*G03G 15/01* (2006.01)

(52) U.S. Cl. ..... 399/308

(58) Field of Classification Search ..... 399/101, 399/302, 303, 308; 430/125.32, 125.4
See application file for complete search history.

(56) References Cited

U.S. PATENT DOCUMENTS

| | | | | |
|---|---|---|---|---|
| 5,744,276 A | | 4/1998 | Ohno | |
| 5,942,366 A | | 8/1999 | Ohno | |
| 6,044,243 A | * | 3/2000 | Hara | 399/302 |
| 6,592,803 B2 | | 7/2003 | Nakazawa | |
| 6,768,892 B2 | | 7/2004 | Sawai | |
| 6,885,842 B2 | | 4/2005 | Sawai | |
| 2006/0154010 A1 | * | 7/2006 | Oyama | 428/36.9 |
| 2007/0292173 A1 | * | 12/2007 | Ikeda et al. | 399/307 |

FOREIGN PATENT DOCUMENTS

| | | | |
|---|---|---|---|
| JP | 07-092737 A | | 4/1995 |
| JP | 11198243 A | * | 7/1999 |
| JP | 2000168989 A | * | 6/2000 |
| JP | 2001-022194 A | | 1/2001 |
| JP | 2003-029550 A | | 1/2003 |
| JP | 2003043830 A | * | 2/2003 |
| JP | 2004-271776 A | | 9/2004 |
| JP | 2004354716 A | * | 12/2004 |
| JP | 2005-037670 A | | 2/2005 |
| JP | 2005275335 A | * | 10/2005 |

* cited by examiner

*Primary Examiner* — Robert Beatty
(74) *Attorney, Agent, or Firm* — Canon USA Inc. IP Division

(57) ABSTRACT

An elastic layer and a top layer of an intermediate transfer belt are configured such that an elastic modulus in a sub-scanning direction is larger than an elastic modulus in a main-scanning direction. Accordingly, when a toner image is transferred onto the intermediate transfer belt, a pressure applied to and affect on a toner is reduced as well as deformation at a sliding-contact portion between the intermediate transfer belt and a cleaning blade can be suppressed.

7 Claims, 16 Drawing Sheets

IMAGE FORMING APPARATUS WITH CLEANING MEMBER

BACKGROUND OF THE INVENTION

1. Field of the Invention

The present invention relates to an electrophotographic type image forming apparatus, such as facsimile machines and printers, which uses toner.

2. Description of the Related Art

In a conventional image forming apparatus, as it is illustrated in FIG. 13, such a configuration is known that a toner image T formed on a front surface of a photosensitive drum 1 is transferred onto a recording material S via an intermediate transfer belt 2. In a case of the illustrated example, since a full color image forming apparatus is used, a developing apparatus 3 includes four colors of development units 4Y, 4M, 4C, and 4*k*. Toner images of the respective colors are sequentially formed on the photosensitive drum 1, so that a full color image is formed on the intermediate transfer belt 2, and thereafter the full color image is transferred onto the recording material S. After the full color image is transferred onto the recording material S, the toner remaining on the intermediate transfer belt 2 is cleaned by causing a cleaning blade 5 to slide and to contact with the intermediate transfer belt 2.

In a case of the image forming apparatus including the intermediate transfer belt 2, a hollow defect that a central portion of an image is not transferred may occur. For example, as it is illustrated in FIG. 14, in a case where a vertical line image is formed in parallel with a recording material conveyance direction, a hollow portion tends to be larger as a line L becomes thinner. The hollow defect tends to occur since a material having a high degree of hardness, e.g., a fluorine resin, a polycarbonate resin, and a polyimide resin, is conventionally used as the intermediate transfer belt 2.

In other words, as it is illustrated in FIG. 15A, if the degree of hardness of the intermediate transfer belt 2 is high, when a layer of a toner t formed on the photosensitive drum 1 is transferred onto the intermediate transfer belt 2, a stress is concentrated onto the toner layer, so that plastic deformation of the toner layer is likely to occur. If the toner layer is plastically deformed, adhesion force (i.e., a real contract area) increases between toners t. If there is a source of roughness on the photosensitive drum 1 in the above state, the adhered toner t attaches at the source of roughness. As a result, the adhered toner t is not transferred onto the intermediate transfer belt 2, and the above described hollow defect occurs. The reason why the hollow portion becomes larger in a thinner line is that the thinner line tends to cause the toner layer to be suffered more stress concentration as described above.

To solve the above problem, as illustrated in FIG. 15B, an elastic layer having an appropriate elastic modulus is provided to the intermediate transfer belt 2 in order to relieve the stress concentrated to the toner t (specifically, of a vertical line image). Accordingly, reduction of the plastic deformation of the toner t can reduce the adhesion force between the toners t, and the hollow defect can be prevented. In a case where the intermediate transfer belt 2 having the above described elastic layer is cleaned by the cleaning blade 5 through a sliding-contacting with the intermediate transfer belt 2, as it is illustrated in FIG. 16A, the front surface of the intermediate transfer belt 2 is elastically deformed to reduce the toner t retained in the sliding-contact portion with the cleaning blade 5.

The toner t existing in the sliding-contact portion functions as a lubricant. Therefore, when the toner t retained in the sliding-contact portion comes to be less, the sliding ability between the intermediate transfer belt 2 and the cleaning blade 5 comes to be unstable. As a result thereof, a chatter mark or a fold occurs and a defect in cleaning tends to occur. On the other hand, in a case where a material having a high degree of hardness is used as the intermediate transfer belt 2, as it is illustrated in FIG. 16B, the toner t is retained more in the sliding-contact portion, so that the sliding ability between the intermediate transfer belt 2 and the cleaning blade 5 can be kept in a good condition except for a tendency of occurrence of the above described hollow defect.

Japanese Patent Application Laid-Open No. 2003-29550 discusses such a configuration that, as it is illustrated in FIG. 13, a lubricant application unit 6 is provided upstream the cleaning blade 5 in order to assist the sliding ability.

Recently, with respect to a request for space saving and cost reduction, a configuration including less number of parts in the image forming apparatus is desired. In a case of the configuration as discussed in the Japanese Patent Application Laid-Open No. 2003-29550, relying on the lubrication function by the lubricant application unit leads causes increase in a size of the lubricant application unit increases, i.e., the request for space saving cannot be satisfied.

In view of the above, more developed cleaning function of the cleaning blade 5 is required. In other words, the cleaning function of the cleaning blade 5 is required that the cleaning performance can be secured even in a case where the lubrication function of the lubricant application unit is low when the lubricant application unit is used.

To enhance the sliding ability between the cleaning blade 5 and the intermediate transfer belt 2, an approaching amount of the cleaning blade 5 with respect to the intermediate transfer belt 2 is required to be small. However, in order to lessen the approaching amount of the cleaning blade 5, an elastic modulus of the elastic layer of the intermediate transfer belt 2 should be raised to harden the elastic layer. In this case, the hollow defect, however, tends to occur for the reason as described above.

SUMMARY OF THE INVENTION

The present invention is directed to an image forming apparatus that can improve a cleaning performance of an elastic belt according to a cleaning blade.

According to an aspect of the present invention, an image forming apparatus includes an image carrier of which surface is formed with a toner image, a belt member configured to have an elastic layer and carry the toner image formed on the image carrier, a transfer unit configured to form a nip portion where the toner image on the image carrier is transferred onto the belt member, and a cleaning member configured to clean toner remaining on a front surface of the belt member after the toner image formed on the front surface of the belt member is transferred onto a transfer material, wherein a portion having a predetermined thickness from the front surface of the belt member has an elastic modulus in a thickness direction smaller than a smaller elastic modulus among an elastic modulus of the toner when the toner is transferred in the nip portion and an elastic modulus of the cleaning member, and an elastic modulus of the belt member in a rotational direction thereof is larger than an elastic modulus of the belt member in a width direction thereof.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4A is the Example 1 of the present invention and FIG. 4B is the Comparative example 1.

DESCRIPTION OF THE EMBODIMENTS

Figure 1:
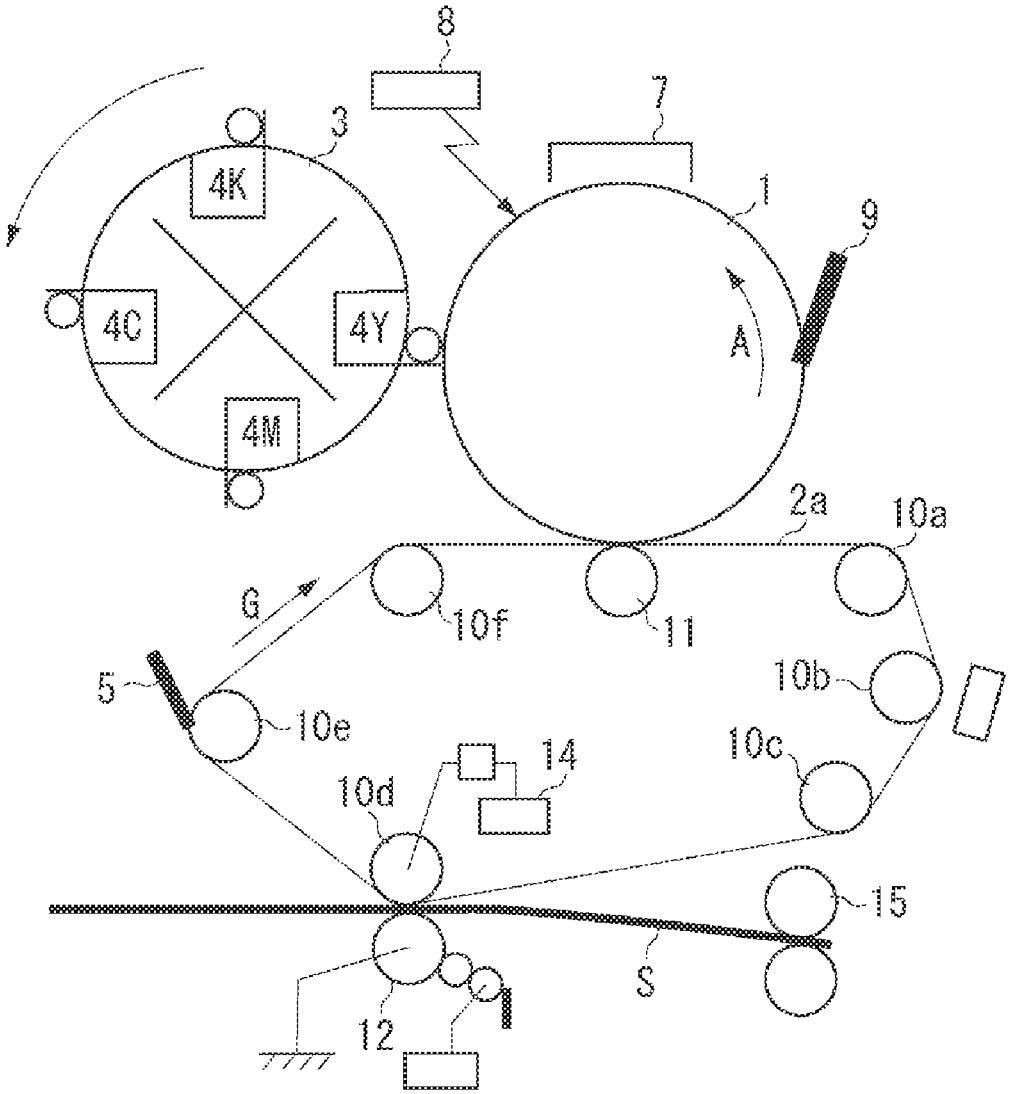
FIG. 1 is a schematic configuration of an image forming apparatus according to a first exemplary embodiment of the present invention.

Various exemplary embodiments, features, and aspects of the invention will be described in detail below with reference to the drawings.

A first exemplary embodiment of the present invention is described with reference to FIGS. 1 through 6. Initially, an image forming apparatus according to the present exemplary embodiment is described with reference to FIG. 1. Around a photosensitive drum 1 as a first image carrier, there are arranged a charging device 7 such as a corona charger, an exposure device 8, a developing apparatus 3, an intermediate transfer belt 2*a* as a belt member, and a drum cleaning member 9.

The photo sensitive drum 1 is rotated in an arrow A direction to form a toner image on a front surface of the photosensitive drum 1 in a manner as described below. The charging device 7 uniformly charges the front surface of the photosensitive drum 1. The exposure device 8 exposes the front surface of the photosensitive drum 1 that is charged based on image information to light. An electrostatic latent image according to the image information is formed according to a conventional electrophotographic process onto the front surface of the photosensitive drum 1.

The developing apparatus 3 includes development units 4Y, 4M, 4C, and 4*k*, respectively including a yellow (Y) toner, a magenta (M) toner, a cyan (C) toner, and a black (k) toner. An electrostatic latent image formed on the front surface of the photosensitive drum 1 is developed by the development units 4Y, 4M, 4C, and 4*k* to form a toner image on the front surface of the photosensitive drum 1. In the present exemplary embodiment, a reversal development method that the toner is attached to an exposed portion of the electrostatic latent image to develop the toner image is used.

The intermediate transfer belt 2*a* is an endless belt arranged so as to contact with the front surface of the photosensitive drum 1. The intermediate transfer belt 2*a* is configured to have a peripheral length of, for example, 527.5 mm, be stretched by a plurality of stretch rollers 10*a* through 10*f*, and be rotated in an arrow G direction. In the present exemplary embodiment, the stretch roller 10*c* is a tension roller that constantly controls a tensile force of the intermediate transfer belt 2*a*, the stretch roller 10*e* is a driving roller of the intermediate transfer belt 2*a*, and the stretch roller 10*d* is a secondary transfer counter roller, respectively. The drum cleaning member 9 sliding-contacts with the front surface of the photosensitive drum 1 and cleans the toner remaining on the front surface of the photosensitive drum 1 after the toner image is transferred onto the intermediate transfer belt 2*a*.

A primary transfer roller 11 is arranged at a primary transfer position of the intermediate transfer belt 2*a* (i.e., on a rear surface side of the intermediate transfer belt 2*a*) facing to the photosensitive drum 1. Application of a primary transfer bias of a normal polarity having a polarity opposite to a charging polarity of the toner to the primary transfer roller 11 causes the toner image on the photosensitive drum 1 to be primary-transferred onto the intermediate transfer belt 2*a*.

A secondary transfer roller 12 and a counter roller 13 are arranged at a secondary transfer position of the intermediate transfer belt 2*a* facing to a conveyance path of a recording material S onto which the toner image is transferred from the intermediate transfer belt 2*a*. The secondary transfer roller 12 is arranged so as to be pressed against a toner image carrying surface (i.e., a front surface) side of the intermediate transfer belt 2*a*. The stretch roller 10*d* (i.e., a counter roller) is arranged at a rear surface side of the intermediate transfer belt 2*a* to form an opposite electrode of the secondary transfer roller 12 to which a secondary transfer bias is applied. When the toner image on the intermediate transfer belt 2*a* is transferred onto the recording material S, the secondary transfer bias having a polarity identical to a polarity of the toner is applied to the stretch roller 10*d* by the transfer bias application unit 14. For example, the secondary transfer bias of −2,000 to −3,000 V is applied and current of −40 to −50 μA is carried.

A cleaning blade 5 as a cleaning member is arranged at a downstream side of the secondary transfer position. The cleaning blade 5 is arranged around the intermediate transfer belt 2*a* and at a position opposite to the stretch roller 10*e*. The cleaning blade 5 sliding-contacts with the front surface of the intermediate transfer belt 2*a* along an arrow G direction, i.e., the toner conveyance direction. Further, a leading edge of the cleaning blade 5 is brought into sliding-contact with the surface of the intermediate transfer belt 2*a* such that the leading edge opposes to a running direction (i.e., a rotating direction, the arrow G direction) of the intermediate transfer belt 2*a*. After the toner image transferred onto the front surface of the intermediate transfer belt 2*a* is further transferred onto the recording material S, the toner remaining on the front surface of the intermediate transfer belt 2*a* is cleaned.

Further, in the present exemplary embodiment, after the recording material S fed from a recording material conveyance apparatus (not shown) is once stopped and positioned at the registration roller pair 15, the recording material S is sent to the secondary transfer position at a predetermined timing.

A primary transfer roller 11 and a secondary transfer roller 12 are formed such that, for example, a metal cored bar having an outer diameter of 8 to 12 mm is covered with a conductive material layer so as to have an outer diameter of, for example, 16 to 30 mm. The conductive material layer is configured such that a rubber, for example, a polymeric elastomer such as a hydrin rubber or an ethylene propylen dien monomer (EPDM), and a polymer foam material, as abase material is used and an ion conductive agent is mixed with the rubber. Accordingly, conductivity is adjusted to a middle resistive region, e.g., a range between 1 MΩ and 100 MΩ.

A top surface of the secondary transfer roller 12 is coated with a resin coat, e.g., urethane or nylon, with a thickness of 2 to 10 μm. The primary transfer roller 11 and the secondary transfer roller 12 having a degree of hardness of, for example, 25° to 40° in Asker C hardness scale, are used. The primary transfer roller 11 applies a load of, for example, 5.9 to 14.7 N (600 to 1,500 gf) to the photosensitive drum 1 and the secondary transfer roller 12 applies a load of, for example, 14.7 to 49.0 N (1,500 to 5,000 gf) to the secondary transfer stretch roller 10*d*.

The image forming apparatus according to the present exemplary embodiment having the above described configuration forms an unfixed toner image of each color on the photosensitive drum 1 every single rotation of the intermediate transfer belt 2*a* arranged facing to the photosensitive drum 1. The unfixed toner images are sequentially electrostatically primary transferred onto the intermediate transfer belt 2*a* by the primary transfer roller 11. Accordingly, a full color image that unfixed toner images of four colors are overlapped to each other on the intermediate transfer belt 2*a* is obtained. On the other hand, remaining toner on the front surface of the photosensitive drum 1 is cleaned by the drum cleaning member 9 per every single rotation of the photosensitive drum 1 after the primary transfer processing. Then, image forming processing is repeated.

The full color image on the intermediate transfer belt 2*a* is transferred at the secondary transfer position to the recording material S fed at a predetermined timing by the registration roller pair 15. After the secondary transfer processing, the toner remaining on the intermediate transfer belt 2*a* is cleaned by the cleaning blade 5. The recording material S after being subjected to the secondary transfer processing is conveyed to a fixing device by a conveyance member, which are not shown. Then, the toner is fused and adhered onto the recording material S.

Figure 2:
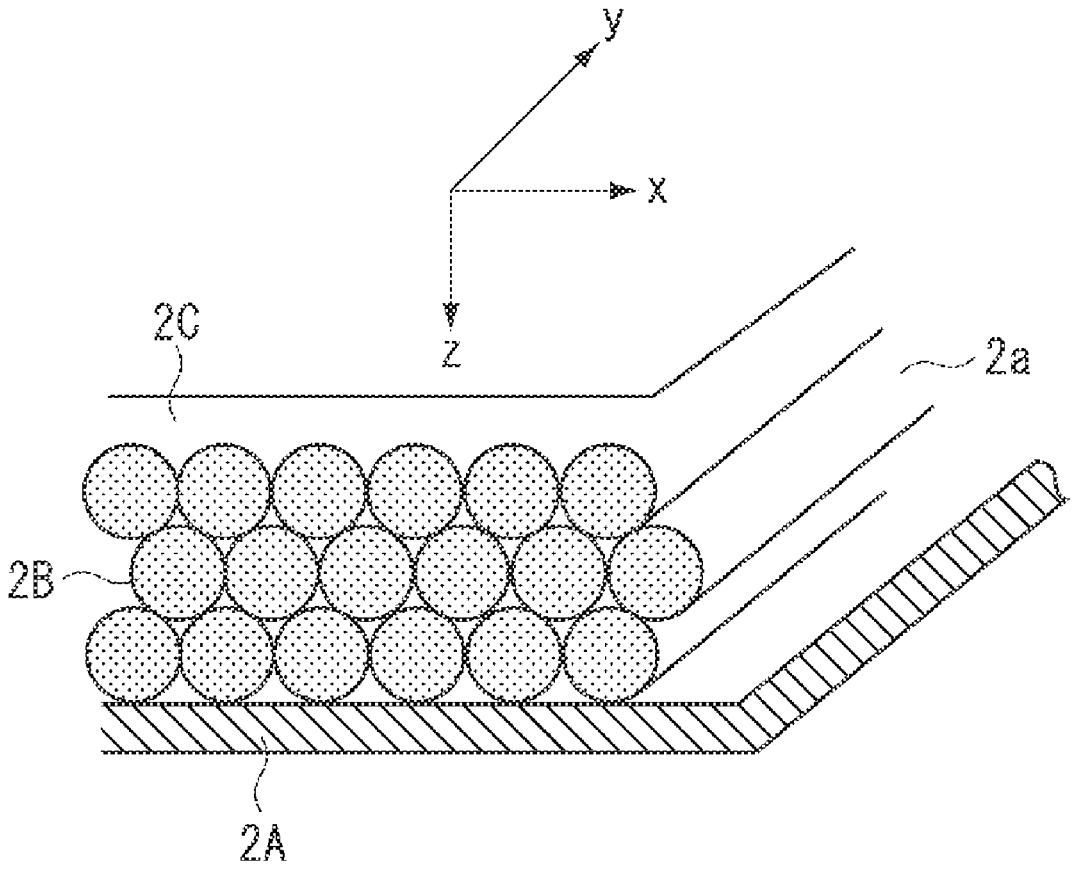
FIG. 2 is a cross sectional perspective view schematically illustrating layers composing an intermediate transfer belt according to the first exemplary embodiment.

In the present exemplary embodiment, the intermediate transfer belt 2*a* includes, as it is illustrated in FIG. 2, a base layer 2A, an elastic layer 2B, and a top layer 2C in this order from an inner periphery surface side at an opposite side of the photosensitive drum 1 so as to be laminated to each other. In the present exemplary embodiment, a combination of the elastic layer 2B and the top layer 2C corresponds to a predetermined thickness portion from a front surface recited in the scope of the invention. The elastic layer 2B and the top layer 2C have configurations as described below.

An elastic modulus in a thickness direction z that is a direction vertical to a front surface of the intermediate transfer belt 2*a* is set to a value smaller than a value of a smaller one of an elastic modulus of the toner when the toner is transferred to the photosensitive drum 1 at the nip portion and an elastic modulus of the cleaning blade 5. An elastic modulus in a sub-scanning direction y that is a rotation direction of the intermediate transfer belt 2*a* is set to a value larger than an elastic modulus in a main-scanning direction x as a width direction of the intermediate transfer belt 2*a* that is a direction perpendicular to the sub-scanning direction y. The elastic modulus in the main-scanning direction x is set to a value smaller than the elastic modulus of the toner. The elastic modulus in the sub-scanning direction y is set to a value larger than the elastic modulus of the cleaning blade 5.

A configuration of the above described intermediate transfer belt 2*a* is described below in detail. The intermediate transfer belt 2*a* of the present exemplary embodiment has, for example, a surface electric resistivity of E+8~+13Ω/□, a volume resistivity of equal to or greater than E+6~+12 Ω·cm (applied voltage of 100 V, 10 sec, temperature of 23 degrees C., and relative humidity of 50%). A thickness of a laminate including the base layer 2A, the elastic layer 2B, and the top layer 2C is between 300 and 400 μm. A material of the base layer 2A may be anything as far as the material has the above described physical properties but is preferably made of resin.

Examples of the resin that can compose the above described base layer 2A include the following ones. That is, a polyimide resin, a polyamide-imide resin, a polyether-imide resin, a silicone-imide resin, a urethane-imide resin, a polyurethane resin, a polyurea resin, an epoxy resin, a melanin resin, an unsaturated polyester resin, and a vinyl ester resin are exemplified. Another example of a material composing the base layer 2A includes an electrically conductive agent such as carbon black, a conductive metal oxide, and a carbon fiber.

The elastic layer 2B of the intermediate transfer belt 2*a* has a value of JIS A degree of hardness of equal to or less than 60°. A thickness of the elastic layer 2B is set to 200 to 300 μm. The elastic layer 2B may be any one of an ionic conductive elastomer or an electrically conductive elastomer as far as the elastic layer 2B represents a volume resistivity within the above described predetermined range. Publicly known ionic conductive rubber can be used as the ionic conductive elastomer. An ion conductive agent added elastomer may also be used.

Examples of the ionic conductive rubber include a rubber material having a polar group in the composition. More specifically, examples thereof include an acrylonitrile-butadiene rubber, an epihalohydrin rubber (particularly, an epichlorohydrin rubber), a chloroprene rubber, an acrylic rubber, and a polyurethane elastomer.

Examples of the ion conductive agent include tetraethylammonuim, tetrabutylammonium, and dodecyltrimethylammonium (e.g., lauryltrimethylammonium). Examples of the ion conductive agent further include perchlorates of octadecyl trimethyl ammonium (e.g., stearyl trimethyl ammonium), hexadecyl trimethyl ammonium, benzyl trimethyl ammonium, and modified aliphatic dimethylethyl ammonium. Examples thereof further include chlorates, hydrochlorides, bromates, iodates, hydroborofluorides, sulfates, alkyl sulfates, carboxylates, and sulfonates. Examples thereof further include perchlorates, chlorates, hydrochlorides, bromates, iodates, hydroborofluorides, sulfates, alkyl sulfates, carboxylates, and trifluoromethyl sulfates of alkali metals and alkali earth metal, such as lithium, sodium, potassium, calcium, and magnesium. Examples thereof further include sulfonates, and bis(trifluoromethanesulfonyl)imides.

In a case where the electrically conductive agent is mixed with the elastomer composing the elastic layer 2B, as similar to a case of the base layer 2A, carbon black, a conductive metal oxide or a carbon fiber is used.

A thickness of the top layer 2C of the intermediate transfer belt 2*a* is set to, for example, 5 to 10 μm after dried. The top layer 2C is spray-coated onto the elastic layer 2B. Preferably, upon coating, an aqueous fluororubber coating material prepared from a fluororubber emulsion or a solvent-based fluororubber coating material prepared by dissolving a fluororubber in an organic solvent is used.

In the present exemplary embodiment, the intermediate transfer belt 2*a* having the above described configuration is produced, for example, as described below. Initially, a material composing the base layer 2A is continuously supplied to an outer surface of a cylindrical mold from a nozzle while the cylindrical mold is rotated. At the same time, the nozzle is moved in a rotational axis direction (i.e., the sub-scanning direction) of the mold. Then, the material is applied uniformly and cured to form the base layer 2A. Subsequently, the elastic layer 2B is formed on the base layer 2A in the similar manner. Then, the top layer 2C is spray-coated onto the elastic layer 2B. For the purpose of improving releasability of the mold, a mold release agent such as silicone oil may be applied onto a surface of the mold. Alternatively, the mold may be coated with ceramics. Preferably, a liquid discharging port of the nozzle is formed into a tube shape and has a wall thickness of about 0.3 to 3.0 mm.

According to the above described producing method, as it is illustrated in FIG. 2, roughness of small and large pitches of a film thickness of the top layer 2C is formed in the main-scanning direction x. Thus, a tensile modulus of elasticity of each of the elastic layer 2B and the top layer 2C in the main-scanning direction x and the sub-scanning direction y can be differed as described above. A relationship between the elastic modulus of each of the main-scanning direction x, the sub-scanning direction y, and the thickness direction z can be controlled as described above.

A preferable surface texture of the intermediate transfer belt 2*a* has a friction coefficient of equal to or less than 0.6 (HEIDON Type 94 manufactured by Shinto Scientific Co., Ltd.). Accordingly, for example, after the top layer 2C is applied onto the elastic layer 2B, the surface of the elastic layer 2B is pressed against a mold having a predetermined surface roughness to control the surface texture in a manner described above.

An example of preferable setting conditions of the cleaning blade 5 includes, for example, a contact pressure of 25 to 36 gf/cm, a board thickness t of 3 mm, and a free length of 5 mm of the cleaning blade with respect to the stretch roller (driving roller) 10*e*. Such a cleaning blade 5 is preferably made of polyurethane rubber and has 70° to 75° of JIS A degree of hardness. The toner has a volume average particle diameter of about 6 μm.

Consideration is made below as to an Example 1 that satisfies the conditions of the present exemplary embodiment and a Comparative Example 1 in which a relationship between the elastic modulus in the main-scanning direction and the elastic modulus in the sub-scanning direction are different from those of the Example 1.

Table 1 shows an elastic modulus of toner (30 degrees C.), an elastic modulus of the cleaning blade 5, an elastic modulus of the intermediate transfer belts 2*a* and 2*b* in a thickness direction, and an elastic modulus in the main-scanning direction and the sub-scanning direction of each of the top layer 2C and the elastic layer 2B (unit/MPa) of each of the Example 1 and the Comparative Example 1. In addition to the above, a friction coefficient of each of the intermediate transfer belts 2*a* and 2*b* is shown. The intermediate transfer belt 2*a* is used in the Example 1 and the intermediate transfer belt 2*b* is used in the Comparative Example 1. The elastic layer 2B is applied in the sub-scanning direction in the Example 1, whereas the elastic layer 2B is applied in the main-scanning direction in the Comparative Example 1 with respect to the intermediate transfer belt 2*b*.

TABLE 1

| | Toner | Cleaning blade | Thickness direction | Main-scanning direction | Sub-scanning direction | Friction coefficient |
|---|---|---|---|---|---|---|
| Example 1 | 100-1,000 | 20-25 | 12-17 | 25-30 | 32-37 | 0.1-0.6 |
| Comparative Example 1 | 100-1,000 | 20-25 | 12-17 | 32-37 | 25-30 | 0.1-0.6 |

The elastic modulus of each of the toner, the cleaning blade 5 and the intermediate transfer belts 2*a* and 2*b* in the thickness direction was measured using HM 2000 manufactured by Fischer Instruments K.K. The elastic modulus of each of the top layer 2C and the elastic layer 2B of the intermediate transfer belts 2*a* and 2*b* in the main-scanning direction and the sub-scanning direction was measured using a tensile tester MODEL-1605N manufactured by AIKOH ENGINEERING CO., LTD. The friction coefficient of the surface of each of the intermediate transfer belts 2*a* and 2*b* was measured using HEIDON Type 94 manufactured by Shinto Scientific Co., Ltd.

Figure 3A:
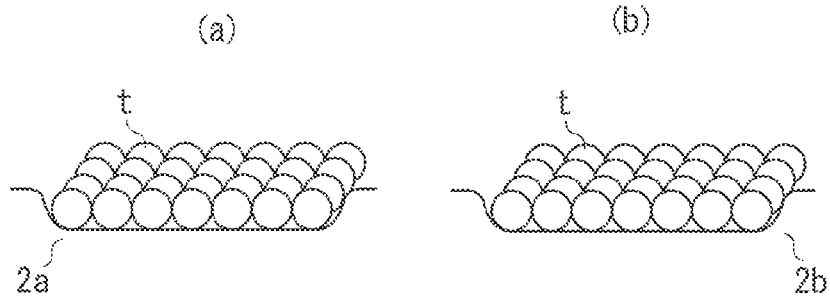
FIGS. 3A through 3C, respectively, are perspective views schematically illustrating a state of a toner layer and the intermediate transfer belt at a nip portion of an Example 1 (a) and a Comparative Example 1 (b).
Figure 3B:
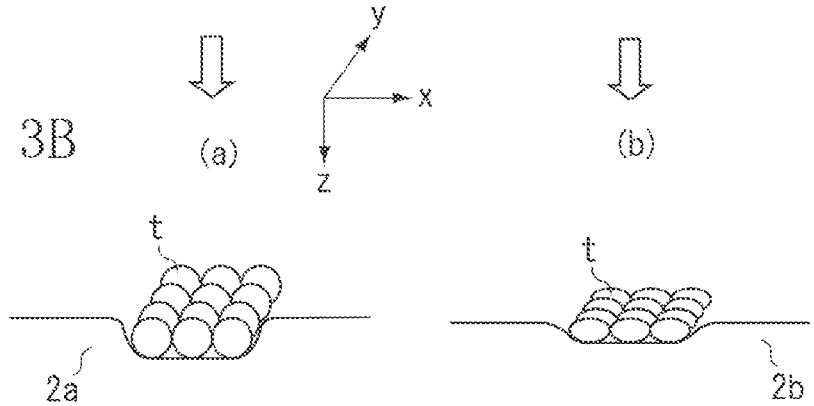
Figure 3C:
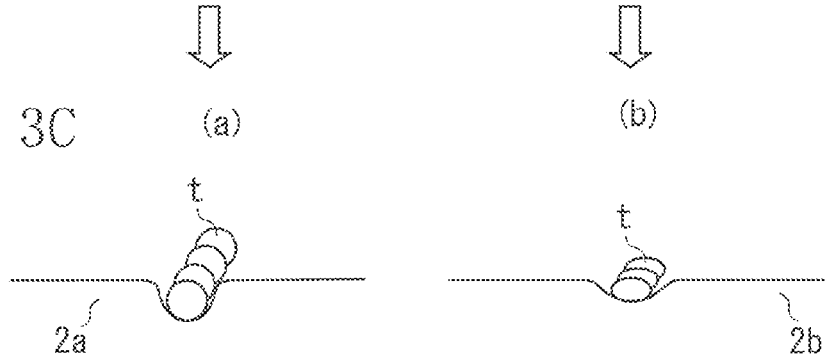

FIGS. 3A through 3C respectively illustrate a relationship between the toner t and each of the intermediate transfer belts 2*a* and 2*b* of the Example 1 (a) and the Comparative Example 1 (b). An amount of the toner t in the main-scanning direction x is reduced in FIG. 3A, FIG. 3B, and FIG. 3C in this order. As it is illustrated in FIG. 3A, when there is more amount of the toner t in the main-scanning direction x in both of the Example 1 and the Comparative Example 1, deformations of the intermediate transfer belts 2*a* and 2*b* hardly causes deformation of the toner t. This is because, a stress applied to the toner t is dispersed within a transfer nip portion and the elastic modulus in the thickness direction of each of the intermediate transfer belts 2*a* and 2*b* is lower than the elastic modulus of the toner t. Accordingly, the adhesion force (i.e., the real contact area) between toners according to the plastic deformation of the toner t increases and thus no hollow defect occurs.

However, as it is illustrated in FIGS. 3B and 3C, when the amount of the toner t in the main-scanning direction x becomes less, since the elastic modulus in the main-scanning direction x of the Comparative Example 1 is higher than that of the Example 1, deformation of the intermediate transfer belt 2*b* in the main-scanning direction x becomes less as illustrated in FIGS. 3B(b) and 3C(b). Since the deformation of the intermediate belt 2*b* comes to be less, deformation of the toner comes to be more. On the other hand, in a case of the Example 1, the intermediate transfer belt 2*a* tends to be deformed in the main-scanning direction x in comparison with the Comparative Example 1, as it is illustrated in FIGS. 3B(a) and 3C(a), and thus deformation of the toner can be reduced.

Figure 4A:
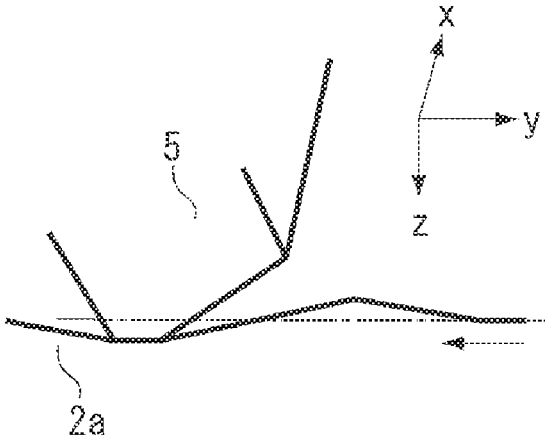
FIGS. 4A and 4B, respectively, are schematic views illustrating a state of a sliding contact portion between a cleaning blade and an intermediate transfer belt.
Figure 4B:
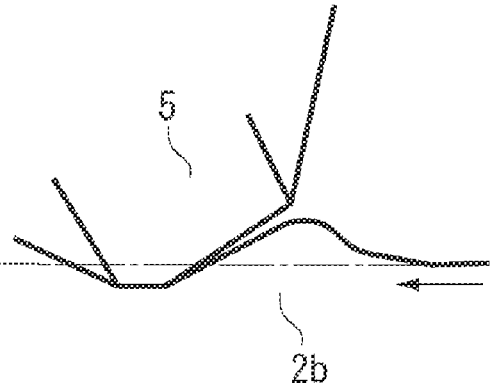

FIGS. 4A and 4B respectively illustrate a sliding-contact portion between the cleaning blade 5 and the intermediate transfer belt 2*a* in the Example 1 and a sliding-contact portion between the cleaning blade 5 and the intermediate transfer belt 2*b* in the Comparative Example 1. As it is illustrated in FIG. 4B, since the elastic modulus of the intermediate transfer belt 2*b* in the sub-scanning direction y in the Comparison Example 1 is lower than that of the Example 1, a portion where the cleaning blade 5 contacts the intermediate transfer belt 2*b* comes to form a steep mountain. This is because, when the intermediate transfer belt 2*b* having the friction coefficient of a range between 0.1 and 0.6 is moved in an arrow direction in the drawing to be slide-contact with the cleaning blade 5, the intermediate transfer belt 2*b* tends to be deformed in the sub-scanning direction y.

Figure 16A:
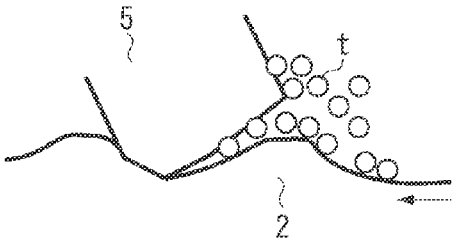
FIG. 16A PRIOR ART
FIGS. 16A and 16B respectively illustrate a relationship between a cleaning blade and the intermediate transfer belt when an elastic layer has different elastic modulus.
Figure 16B:
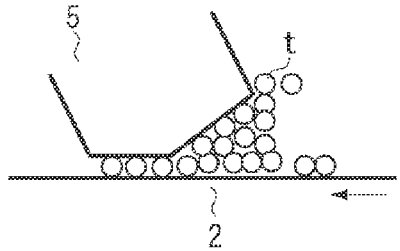
FIG. 16B PRIOR ART

In the above described state, as it is illustrated in FIG. 16A, the amount of toner t retained in the sliding-contact portion becomes less and thus the number of particles functioning as the lubricant reduces. As a result thereof, the sliding ability between the intermediate transfer belt 2*b* and the cleaning blade 5 comes to be unstable and thus a chatter mark and a fold occur to cause defect in cleaning. On the other hand, since the elastic modulus in sub-scanning direction y of the Example 1 is higher than that of the Comparative Example 1, the steep mountain illustrated in FIG. 4B can be prevented as it is illustrated in FIG. 4A. Therefore, the number of particles retained in the sliding-contact portion, functioning as the lubricant, can be increased in comparison with that of the Comparative Example 1, and the sliding ability between the intermediate transfer belt 2*a* and the cleaning blade 5 can be maintained stable.

Figure 5A:
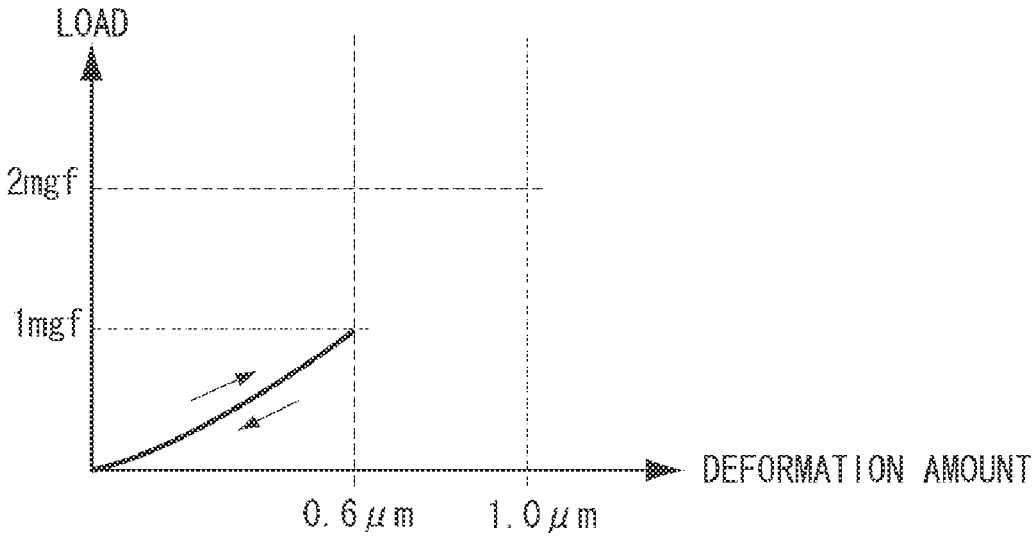
FIGS. 5A and 5B respectively illustrate a deformation amount of toner.

An experimental result that the elastic property of the toner was checked is described below. In the experiment, the toner was placed on the sheet composed only of the base layer 2A of the intermediate transfer belt 2*a* used in the Example 1, a load was applied to the toner from the vertical direction with respect to the base layer 2A, and the load was gradually removed. As a result thereof, as it is illustrated in FIG. 5A, deformation amount of the toner returns to about zero until the deformation of toner becomes 0.6 μm, i.e., the elastic deformation was shown.

Figure 5B:
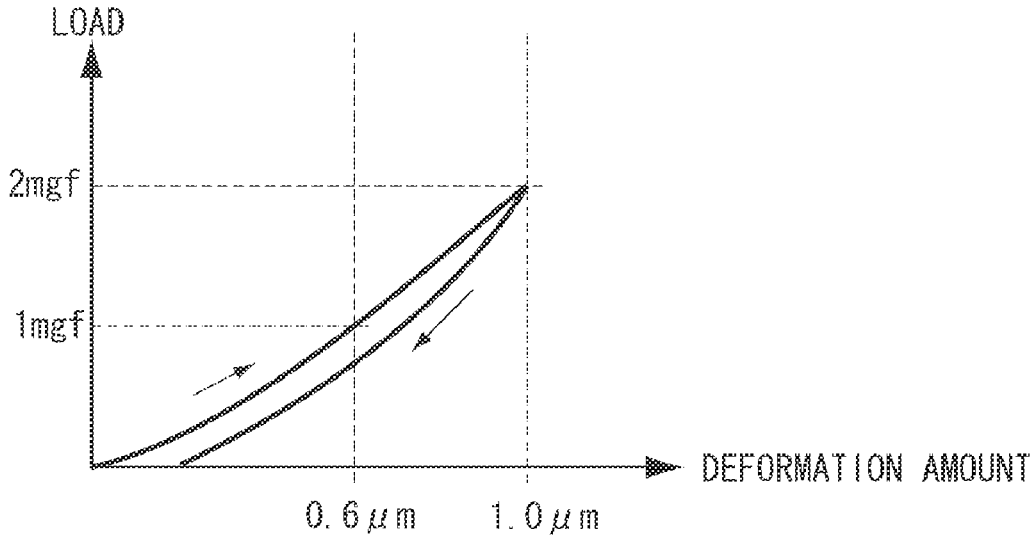

On the other hand, as it is illustrated in FIG. 5B, in a case where the load was removed after the toner was deformed by about 1 μm, the deformation amount of toner did not return to the original value, and it showed plastic deformation. A similar test was carried out with respect to the intermediate transfer belt 2*a* of the Example 1 using the above described toner, and the deformation amount of the toner could be less than about 0.6 μm. As a result of the experiment, if the intermediate transfer belt 2*b* of the Example 1 is used, the toner can be transferred from the photosensitive drum 1 to the intermediate transfer belt 2*a* without causing plastic deformation of the toner.

Figure 6A:
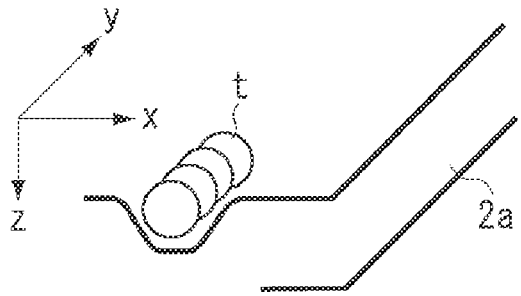
FIGS. 6A through 6C, respectively, are perspective views schematically illustrating a relationship between the toner and the intermediate transfer belt, a relationship between the cleaning blade and the intermediate transfer belt, and a relationship between a cleaning blade having a configuration other than the present invention and the intermediate transfer belt.
Figure 6B:
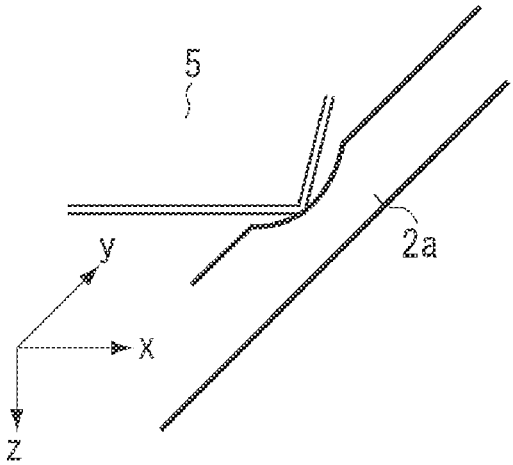

When an image was actually formed by the above described Example 1, as it is illustrated in FIG. 6A, since a pressure that was applied in the thickness direction and received by the transfer nip portion deforms the intermediate transfer belt 2*a*, the plastic deformation of the toner t was suppressed, and increase of the adhesion force between the toners (i.e., the real contact area) cloud be reduced. In addition, as it is illustrated in FIG. 6B, the cleaning blade 5 could be brought into a state that a portion where the cleaning blade 5 comes into the intermediate transfer belt 2*a* is prevented from forming a steep mountain. As a result thereof, prevention of the hollow defect of toner due to deformation at the transfer nip portion can be realized as well as the cleaning ability owing to the stability of the sliding ability between the cleaning blade 5 and the intermediate transfer belt 2*a* can be enhanced.

Figure 6C:
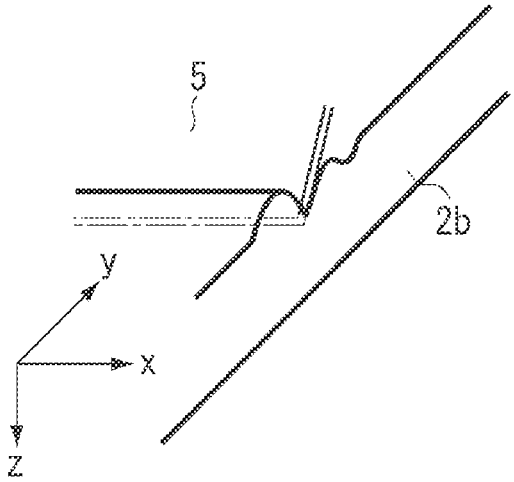

On the other hand, when an image was actually formed according to the Comparative Example 1, the plastic deformation of the toner due to the pressure that was applied in the thickness direction and received by the transfer nip portion could not be suppressed in comparison with a case of the Example 1, and thus the adhesion force (i.e., the real contact area) between the toners increased, resulting in occurrence of the hollow defect. Further, as it is illustrated in FIG. 6C, a portion where the cleaning blade 5 came into the intermediate transfer belt 2*b* formed a steep mountain, so that the chatter mark of the intermediate transfer belt 2*b* was started upon an operation of the cleaning blade 5 and then the folding of the intermediate transfer belt 2*b* occurred.

As it is apparent from the above described consideration result and experimental result, in the present exemplary embodiment, the elastic modulus of each of the elastic layer 2B and the top layer 2C of the intermediate transfer belt 2*a* in the thickness direction is smaller than the elastic modulus of the toner when the toner is transferred at the nip portion. Therefore, the intermediate transfer belt 2*a* tends to be deformed according to the pressure that is received by the nip portion in the thickness direction when the toner is transferred. Consequently, the plastic deformation of the toner can be suppressed and increasing of the adhesion force (i.e., the real contact area) between the toners can be prevented, so that occurrence of the hollow defect can be prevented.

The elastic modulus of each of the elastic layer 2B and the top layer 2C of the intermediate transfer belt 2*a* in the thickness direction is smaller than the elastic modulus of the cleaning blade 5. However, the elastic modulus of this portion in the sub-scanning direction is set to a value larger than the elastic modulus in the main-scanning direction. Accordingly, deformation hardly occurs in the front surface of the intermediate transfer belt 2*a* at the sliding-contact portion between the cleaning blade 5 and the intermediate transfer belt 2*a*. Therefore, the toner serving as the lubricant can be sufficiently retained in the sliding-contact portion between the cleaning blade 5 and the intermediate transfer belt 2*a*. The sliding ability of the cleaning blade 5 can be enhanced as well as the cleaning ability of the cleaning blade 5 can be improved.

The elastic modulus of each of the elastic layer 2B and the top layer 2C of the intermediate transfer belt 2*a* in the thickness direction can be made smaller than the elastic modulus of the toner and the elastic modulus of the cleaning blade 5 by making the elastic modulus of each of the elastic layer 2B and the top layer 2C of the intermediate transfer belt 2*a* in the main-scanning direction smaller.

As described above, in the present exemplary embodiment, both of the prevention of the hollow defect and the enhancement of the cleaning ability can be realized with a simple configuration that the elastic moduli of the elastic layer 2B and the top layer 2C of the intermediate transfer belt 2*a* in the sub-scanning direction are set different from those in the main-scanning direction.

The elastic modulus of each of the elastic layer 2B and the top layer 2C of the intermediate transfer belt 2*a* in the main-scanning direction is set to a value smaller than the elastic modulus of the toner, thereby reducing the deformation amount of the toner. Therefore, occurrence of the hollow defect can be more stably prevented. The elastic modulus of each of the elastic layer 2B and the top layer 2C in the sub-scanning direction is set to a value larger than the elastic modulus of the cleaning blade 5, so that the cleaning blade 5 can be press contacted against the intermediate transfer belt 2*a* without steeply deforming the elastic layer 2B and the top layer 2C. Accordingly, the cleaning ability of the cleaning blade 5 can be made more stable.

A second exemplary embodiment of the present invention is described below with reference to FIGS. 7A through 7C and FIGS. 8A and 8B. A basic configuration and an operation of an image forming apparatus according to the second exemplary embodiment are similar to those of the above described first exemplary embodiment, so that redundancy of the drawings and descriptions are omitted or simplified. An intermediate transfer belt 2*c* of the present exemplary embodiment is formed such that a base layer 2A, an elastic layer 2B, and a top layer 2C are laminated to each other in a manner similar to the intermediate transfer belt 2*a* of the above described first exemplary embodiment.

In other words, also in the present exemplary embodiment, a portion having a predetermined thickness from a front surface of the intermediate transfer belt 2*c* includes more than two layers, i.e., the elastic layer 2B and the top layer 2C, so as to be laminated one another in the thickness direction. The relationships in size between the elastic modulus in the thickness direction z, the elastic modulus in the sub-scanning direction y, and the elastic modulus in the main-scanning direction x of each of the elastic layer 2B and the top layer 2C, the elastic modulus of the toner, and the elastic modulus of the cleaning blade 5 are similar to those in the above described first exemplary embodiment.

In the present exemplary embodiment, in addition to the above described configuration, the elastic modulus of the top layer 2C is set different from the elastic modulus of the elastic layer 2B and the elastic modulus of the top layer 2C of a most front surface side is set to a value larger than the elastic modulus of the elastic layer 2B. More specifically, a material having the elastic modulus larger than that of a material of the elastic layer 2B is used as the material of the top layer 2C. A surface texture of the intermediate transfer belt 2*c* is set such that a ten-point average roughness Rz (JIS B0601-1994) is less than a volume average particle diameter of the toner. For example, the volume average particle diameter of the toner is 6 μm, the ten-point average roughness Rz is set to less than 6 μm.

Figure 7A:
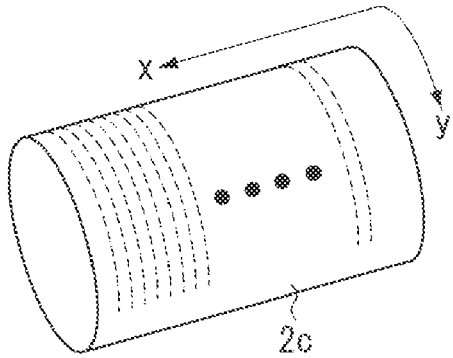
FIGS. 7A through 7C, respectively, are perspective views schematically illustrating an entirety of an intermediate transfer belt, a cross sectional view of the intermediate transfer belt, and an enlarged view of a portion "D" encircled with an alternate long and short dash line of FIG. 7B of the intermediate transfer belt of a second exemplary embodiment of the present invention.
Figure 7B:
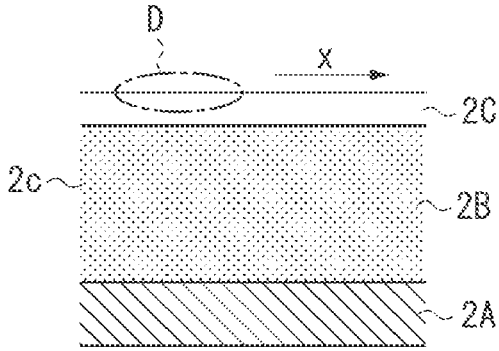
Figure 7C:
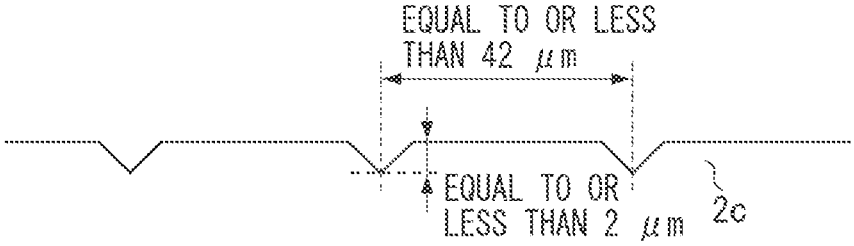

In the present exemplary embodiment, in order to obtain the above described surface texture, the front surface of the intermediate transfer belt 2*c* is roughened in the sub-scanning direction y. For example, the ten-point average roughness Rz in the sub-scanning direction y is set to a value equal to or less than 2 μm. The surface texture of the intermediate transfer belt 2*c* is made to a state that, as it is schematically illustrated in FIG. 7A, a plurality of stripes extending in the sub-scanning direction y are distributed in the main-scanning direction x. Dots in FIG. 7A represent a repetition of the plurality of stripes.

In the surface texture of the intermediate transfer belt 2*c*, an average distance Sm (JIS B0601-1994) of unevenness of the surface roughness in the main-scanning direction is set so as to be smaller than a minimum pixel width of a toner image formed on the front surface of the intermediate transfer belt 2*c*. For example, in a case where a resolution is 600 dpi, since 42.3 μm per 1 dot line is the minimum pixel width, the average distance Sm of the unevenness in the main-scanning direction is set to a value less than 42.3 μm, more preferably, equal to or less than 42 μm.

In order to control the surface texture of the intermediate transfer belt 2*c*, in the present exemplary embodiment, the front surface of the intermediate transfer belt 2*c* is pressed against a mold having a predetermined surface roughness after applying the top layer 2C onto the elastic layer 2B, so that the surface texture is controlled in a manner as described above. In consideration with conditions of the surface texture to be formed onto the front surface of the intermediate transfer belt 2*c* and a temperature condition, the surface texture of the front surface of this mold is controlled.

Consideration is made by comparing an Example 2 that satisfies the present exemplary embodiment and a Comparative Example 2 in which a relationship between the elastic modulus in each of the main-scanning direction and the sub-scanning direction differs from the corresponding one of the Example 2. In Table 2, the elastic modulus of toner (30 degrees C.), the elastic modulus of the cleaning blade 5, the elastic modulus of the intermediate transfer belt in the thickness direction, and the elastic modulus of each of the top layer 2C and the elastic layer 2B in each of the main-scanning direction and the sub-scanning direction (unit/MPa) of each of the Example 2 and the Comparative Example 2 are shown. In addition to the above, the friction coefficient of the intermediate transfer belt is also shown. Other conditions are similar to those in the above description as to Table 1. In the Example 2, the surface texture of the intermediate transfer belt 2*c* is controlled as described above.

TABLE 2

| | Toner | Cleaning blade | Thickness direction | Main-scanning direction | Sub-scanning direction | Friction coefficient |
|---|---|---|---|---|---|---|
| Example 2 | 100-1,000 | 20-25 | 12-17 | 23-27 | 32-37 | 0.1-0.6 |
| Comparative Example 2 | 100-1,000 | 20-25 | 12-17 | 32-37 | 25-30 | 0.1-0.6 |

In view of the consideration of the Example 2 and the Comparative Example 2, the following effect can be produced in addition to the effect described with reference to Table 1. More specifically, in addition to the configuration of the Example 1, in the Example 2, since the surface texture of the intermediate transfer belt 2*c* is controlled in a manner as described above, the intermediate transfer belt 2*c* tends to be deformed in the main-scanning direction in comparison with the Example 1, deformation of the toner can be stably reduced.

As it is apparent from the above consideration result, according to the present exemplary embodiment, since the elastic layer 2B has the elastic modulus lower than the elastic modulus of the top layer 2C, deformation of the intermediate transfer belt 2*c* in the thickness direction appears due to the elastic layer 2B. Further, roughness of the front surface of the intermediate transfer belt 2*c* in the sub-scanning direction allows an easy deformation in the main-scanning direction while the intermediate transfer belt 2*c* maintains deformation resistant in the sub-scanning direction.

With the above described configuration, the deformation of the toner at the transfer nip portion tends to be readily reduced as well as the steep deformation between the cleaning blade 5 and the intermediate transfer belt 2*c* at the sliding-contact portion can be readily suppressed. The hollow defect can be prevented as well as the cleaning ability can be enhanced. The surface texture of the intermediate transfer belt 2*c* is configured such that the ten-point average roughness Rz is set to a value less than the volume average particle diameter of the toner, so that the deformation of toner can be reduced more easily.

In the present exemplary embodiment, the average distance Sm of the unevenness of the surface roughness of the intermediate transfer belt 2*c* in the main-scanning direction is set to a value smaller than the minimum pixel width of the toner image. Accordingly, as it is illustrated in FIG. 8A, deformation of the top layer 2C in the main-scanning direction can be readily made with respect to a line image having a minimum width where the stress mostly tends to concentrate (i.e., a vertical line toner image P).

As a result thereof, the deformation of the toner can be reduced and the effect of prevention of the hollow defect can be improved. This point is described below based on the experiment performed by the inventor of the present invention, with reference to FIGS. 8A and 8B. In the present experiment, it was provided that the front surface of the intermediate transfer belt 2*a* of the above described Example 1 was roughen and the average distance Sm of the unevenness in the main-scanning direction were set to 42 μm, 80 μm, and 100 μm, and transfer efficiencies therebetween were compared. An image was formed under the conditions that the volume average particle diameter of the toner was 6 μm and the resolution was 600 dpi. A one dot-vertical line (i.e., the minimum pixel width) in this case was 42.3 μm.

As a result thereof, as the surface roughness shape Sm in the main-scanning direction becomes larger, e.g., 80 μm and 100 μm, the transfer efficiency came to be degraded, especially in the one dot-vertical line, although no hollow defect was seen. Since the front surface of the intermediate transfer belt 2*a* of the Example 1 was additionally roughen, no hollow defect was seen, however, as it is illustrated in FIG. 8B, the toner was partially plastically deformed and thus the adhesion force increased between the toners since the stress concentration to the toner could not be relieved.

Figure 8A:
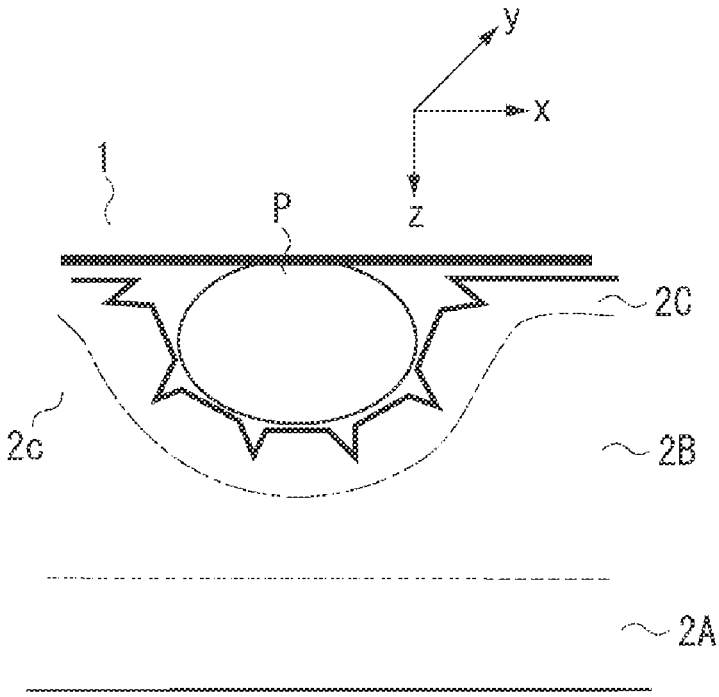
FIGS. 8A and 8B, respectively, are schematic views illustrating a relationship between the toner of a vertical line image and the intermediate transfer belt in a case where surface roughness of the intermediate transfer belt is different to each other.
Figure 8B:
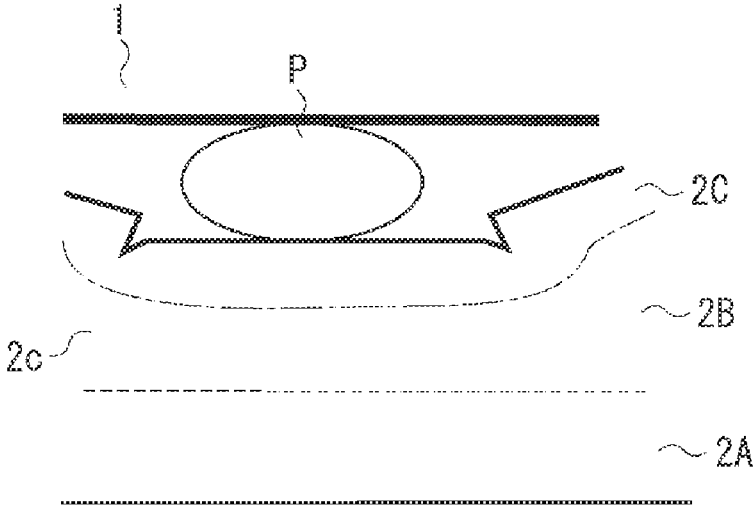

On the other hand, in a case where the surface roughness shape Sm in the main-scanning direction was a value of 42 μm that was less than the minimum pixel width of 42.3 μm, as it is illustrated in FIG. 8A, the intermediate transfer belt 2*a* tends to be deformed in the main-scanning direction. Therefore, the stress concentration applied to the toner could be sufficiently relieved and thus the transfer efficiency was good in the one dot-vertical line. Therefore, according to the present exemplary embodiment, it is found that the plastic deformation of the toner which is a main cause of the hollow defect can be stably reduced.

Figure 10:
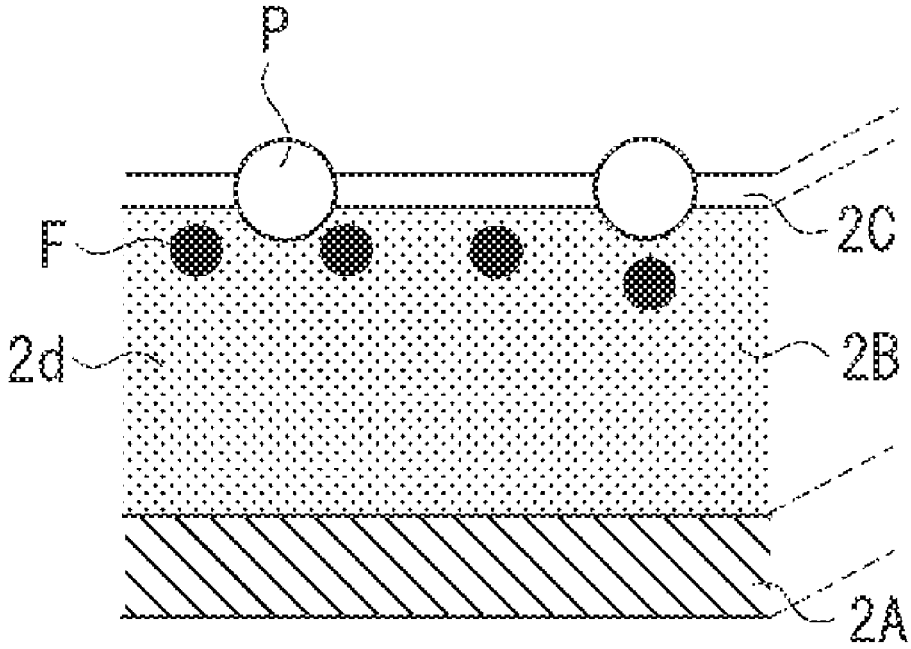
FIG. 10 is a schematic view illustrating a relationship between the toner of a vertical line image and the intermediate transfer belt in the configuration of the third exemplary embodiment.
Figure 11:
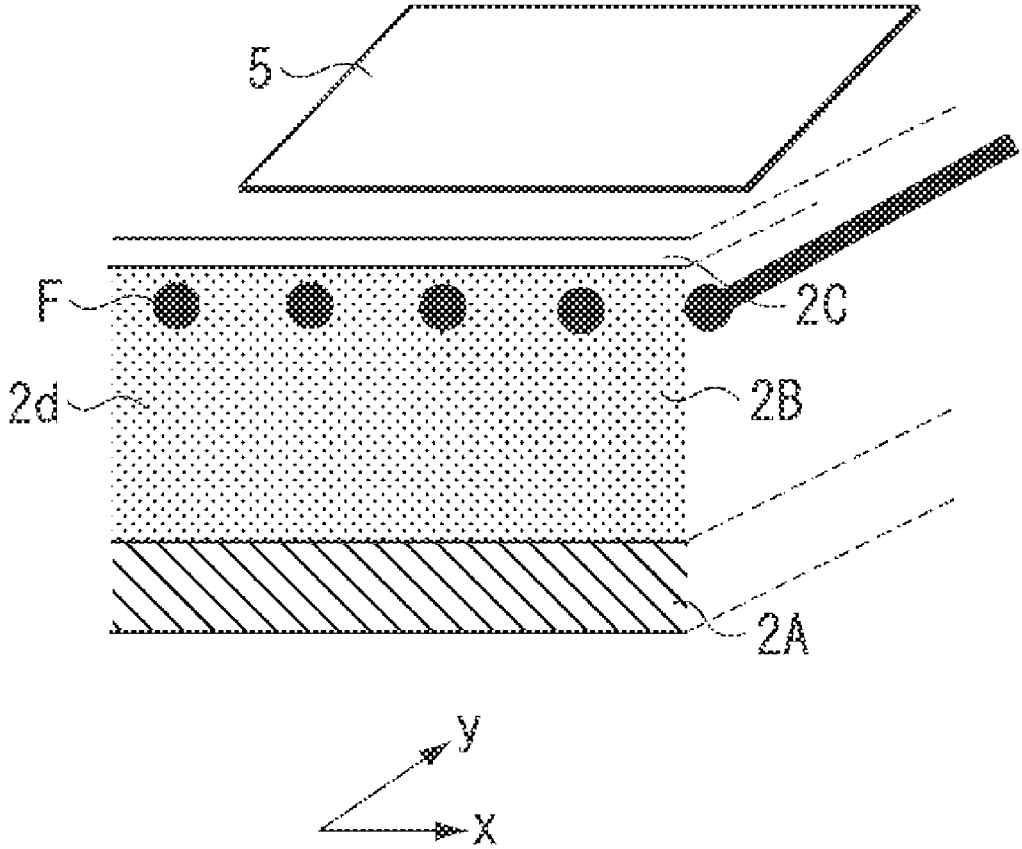
FIG. 11 is a cross sectional perspective view schematically illustrating a relationship between a cleaning blade and the intermediate transfer belt in the configuration of the third exemplary embodiment.

A third exemplary embodiment of the present invention is described below with reference to FIGS. 9 through 11. A basic configuration and an operation of an image forming apparatus according to the third exemplary embodiment are similar to those of the above described first exemplary embodiment, so that redundancy of the drawings and descriptions are omitted or simplified. An intermediate transfer belt 2*d* of the present exemplary embodiment is formed such that a base layer 2A, an elastic layer 2B, and a top layer 2C are laminated to each other in a manner similar to the intermediate transfer belt 2*a* of the above described first exemplary embodiment.

In other words, also in the present exemplary embodiment, a portion having a predetermined thickness from a front surface of the intermediate transfer belt 2*d* includes more than two layers, i.e., the elastic layer 2B and the top layer 2C, so as to be laminated one another in the thickness direction. The relationships in size between the elastic modulus in the thickness direction z, the elastic modulus in the sub-scanning direction y, and the elastic modulus in the main-scanning direction x of each of the elastic layer 2B and the top layer 2C, the elastic modulus of the toner, and the elastic modulus of the cleaning blade 5 are similar to those in the above described first exemplary embodiment.

In the present exemplary embodiment, in addition to the above described configuration, the elastic layer 2B includes a fibrous form filler F, such as a conductive nylon fiber (i.e., a conductive filler), along the sub-scanning direction y. More specifically, as it is illustrated in FIG. 9, the fillers F disposed along the sub-scanning direction y are distributed in the main-scanning direction x spaced by predetermined distances therebetween. The distance between the fibrous form fillers F in the main-scanning direction x is larger than the minimum pixel width (i.e., a vertical line toner image P) of the toner image formed on the front surface of the intermediate transfer belt 2*c* as illustrated in FIG. 10 and is smaller than a width of the cleaning blade 5 in the main-scanning direction x as illustrated in FIG. 11.

Figure 9:
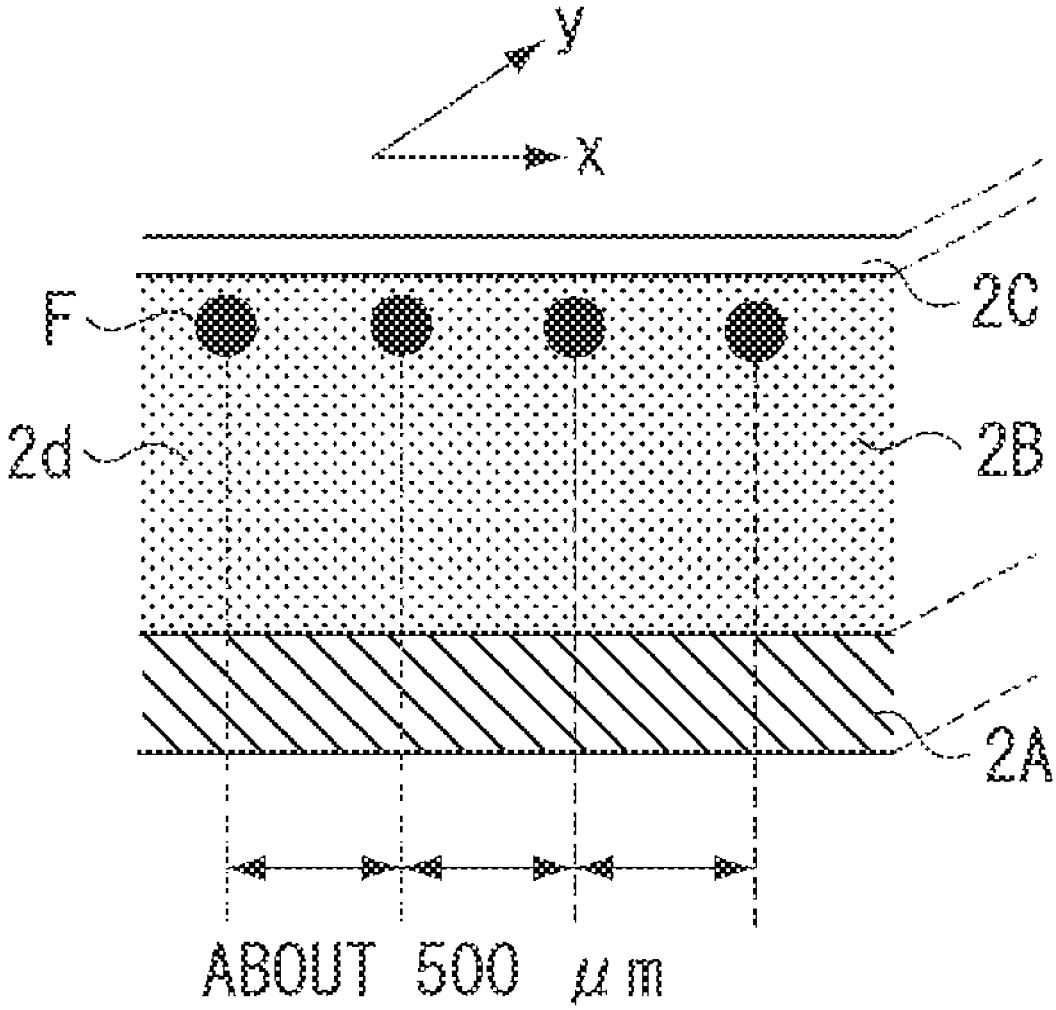
FIG. 9 is a cross sectional view partially schematically illustrating a configuration of an intermediate transfer belt according to a third exemplary embodiment of the present invention.

In the present exemplary embodiment, for example, as it is illustrated in FIG. 9, the conductive nylon fibers 3 to 3.5 denier (g/9000 m) as the fillers F are arranged in parallel to each other in the sub-scanning direction y spaced by equal to or more than about 500 μm in the main-scanning direction x.

A consideration is made by comparing an Example 3 that satisfies the present exemplary embodiment and a Comparative Example 3 in which a relationship between the elastic modulus in the main-scanning direction and the elastic modulus in the sub-scanning direction is different from each other. Table 3 shows the elastic modulus of toner (30 degrees C.), the elastic modulus of the cleaning blade 5, the elastic modulus of the intermediate transfer belt in the thickness direction, and the elastic modulus in the main-scanning direction and the sub-scanning direction of each of the top layer 2C and the elastic layer 2B (unit/MPa) of each of the Example 3 and the Comparative Example 3. In addition to the above, the friction coefficient of the intermediate transfer belt is also shown. Other conditions are similar to those in the above description as to Table 1. Also, the Example 3 includes the fillers F in the elastic layer 2B in a manner as described above.

TABLE 3

| | Toner | Cleaning blade | Thickness direction | Main-scanning direction | Sub-scanning direction | Friction coeffi-cient |
|---|---|---|---|---|---|---|
| Example 3 | 100-1,000 | 20-25 | 14-18 | 25-30 | 35-40 | 0.1-0.6 |
| Comparative Example 3 | 100-1,000 | 20-25 | 14-18 | 35-40 | 25-30 | 0.1-0.6 |

According to the consideration of the Example 3 and the Comparative Example 3, the following effect is produced in addition to the effect described in Table 1. More specifically, in the Example 3, the fillers F are included in the elastic layer 2B as described above in addition to the configuration of the Example 1. Therefore, the intermediate transfer belt tends to hardly deform in the sub-scanning direction owing to the fillers F arranged in parallel to each other in the sub-scanning direction in comparison with the deformation in the main-scanning direction. By using this anisotropy, as it is illustrated in FIG. 10, the deformation of the intermediate transfer belt 2*c* in the thickness direction and the main-scanning direction suppresses the deformation of the vertical line toner image P. In addition, as it is illustrated in FIG. 11, the fillers F arranged in parallel to each other in the sub-scanning direction suppresses steep deformation of the intermediate transfer belt 2*c* in the sub-scanning direction through the applied pressure received from the cleaning blade 5.

As it is apparent from the above consideration result, according to the present exemplary embodiment, since the fillers F are arranged in parallel with each other along the sub-scanning direction, the deformation in the sub-scanning direction can be suppressed. Therefore, the sliding ability of the sliding-contact portion between the intermediate transfer belt 2*c* and the cleaning blade 5 is maintained stably and the good cleaning ability can be secured. Adjustment of the number of the fillers F to be arranged in parallel with each other can optimize the anisotropy of the intermediate transfer belt 2*c* in the main-scanning direction and the sub-scanning direction. This point is described below based on the experiment performed by the inventor of the present invention, with reference to Table 4.

TABLE 4

| Vertical line width | Filler distance (μm) −100 | About 500 | About 10000 |
|---|---|---|---|
| 10 | ○ | ○ | ○ |
| 8 | ○ | ○ | ○ |
| 6 | ○ | ○ | ○ |
| 4 | Δ | ○ | ○ |
| 2 | x | ○ | ○ |
| CLN defect | ○ | ○ | x |

* Vertical line width: 10 is about 420 μm (10 Dot line of 600 dpi)

In the present experiment, the intermediate transfer belts having the distances between the fillers F (i.e., the filler distances) of equal to or less than 100 μm, about 500 μm, and 10,000 μm were prepared to form vertical line toner images having different vertical line widths, and presence or absence of the occurrence of a hollow defect and the cleaning ability were checked. An image was formed under the conditions that the volume average particle diameter of the toner was 6 μm and the resolution was 600 dpi. A one dot-vertical line (i.e., the minimum pixel width) in this case was 42.3 μm. Therefore, for example, the vertical line width of 10 means a 10 dot vertical line of about 420 μm.

A circle in a column of each of the vertical line widths represents that no hollow defect occurred, a triangle in the column represents that few hollow defects occurred, and a cross in the column represents that hollow defects occurred, respectively. On the other hand, a circle in a column of the CLN defect at the bottom of the columns represents that no cleaning defect occurred and a cross in the column of the CLN defect represents that cleaning defect occurred, respectively.

As it is apparent from Table 4, as the distance between the fillers F to be arranged in parallel to each other was made narrower, a hollow defect occurs in 2 to 4 dot lines of the vertical lines. On the other hand, if the distance was made wider, a chatter mark or a fold occurs and further the cleaning defect occurs. Therefore, in consideration of the above, if the fillers F are contained in a suitable manner, the hollow defect can be eliminated as well as the cleaning defect can be prevented. Therefore, for example, the distance between the fillers F is set to a value greater than 100 μm and less than 10,000 μm. Also, a preferable distance is equal to or more than 200 μm and equal to or less than 9,000 μm, more preferably, equal to or more than 500 μm and equal to or less than 1,000 μm.

Figure 12:
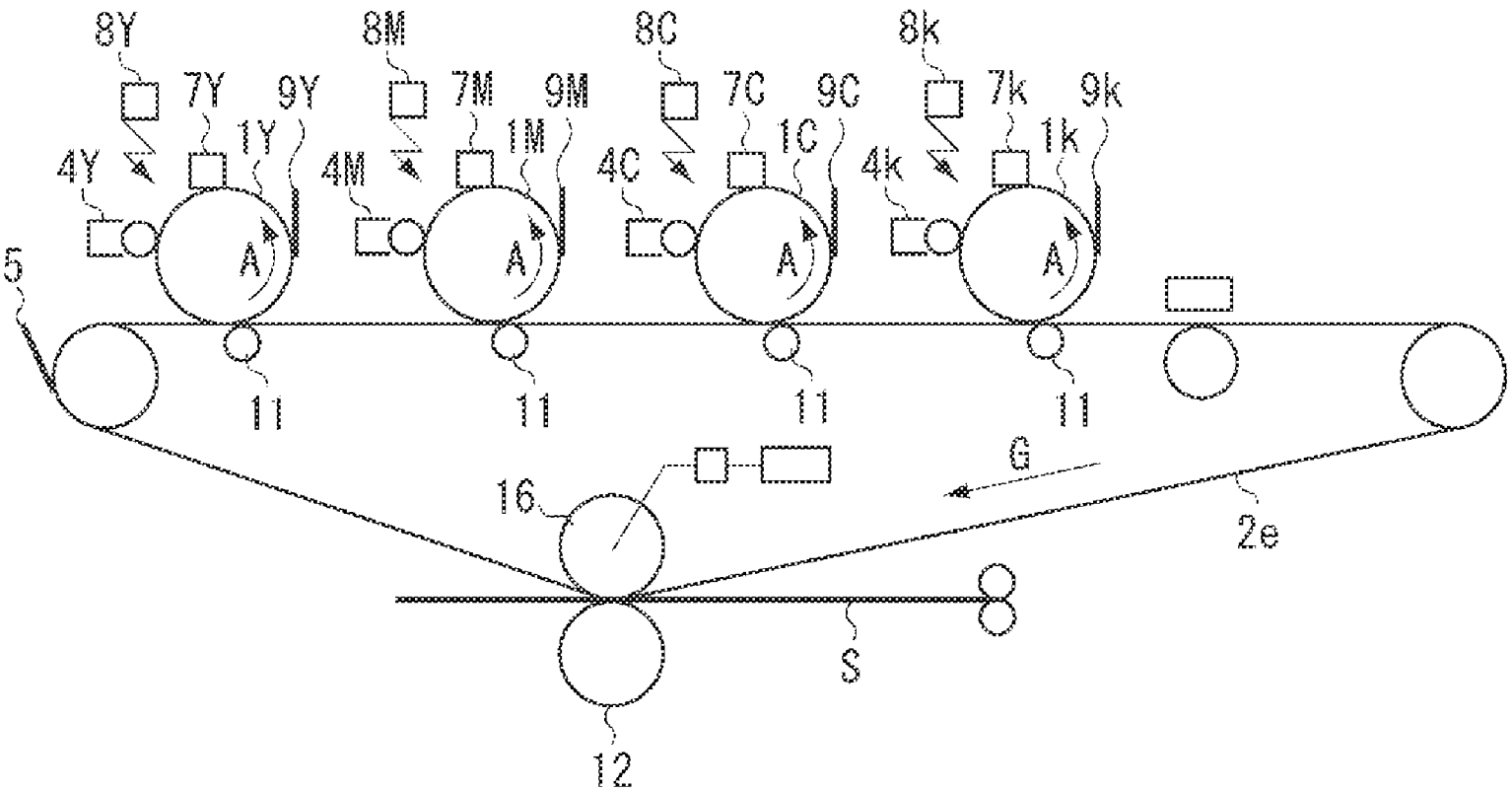
FIG. 12 is a schematic configuration of an image forming apparatus according to a fourth exemplary embodiment of the present invention.
Figure 13:
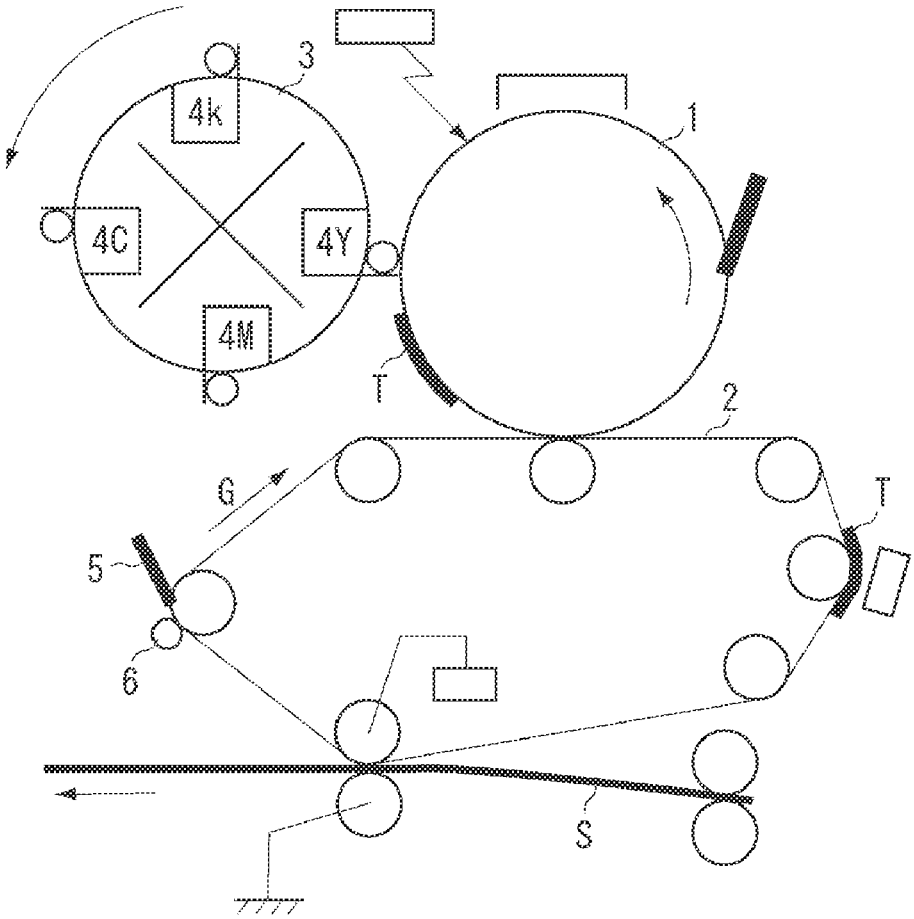
FIG. 13 PRIOR ART
FIG. 13 is a schematic configuration illustrating an example of a conventional image forming apparatus.
Figure 14:
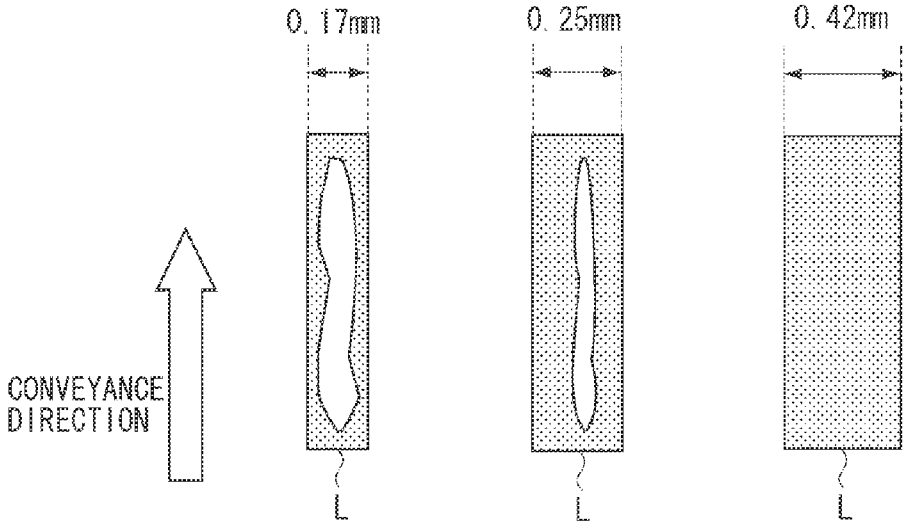
FIG. 14 PRIOR ART
FIG. 14 illustrates vertical line images having different thicknesses side by side in order to explain a hollow defect.
Figure 15A:
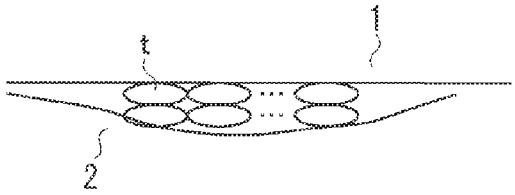
FIG. 15A PRIOR ART
FIGS. 15A and 15B respectively illustrate a relationship between the toner layer and the intermediate transfer belt at a nip portion when an elastic layer has different elastic modulus.
Figure 15B:
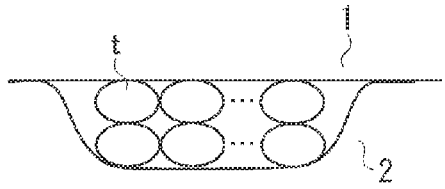
FIG. 15B PRIOR ART

A fourth exemplary embodiment of the present invention is described below with reference to FIG. 12. In the present exemplary embodiment, the present invention is applied to a tandem type image forming apparatus in which a plurality of photosensitive drums 1Y, 1M, 1C, and 1*k* are arranged side by side on the intermediate transfer belt 2*e*. More specifically, the intermediate transfer belt 2*e* corresponds to the intermediate transfer belts 2*a*, 2*c*, and 2*d* of the above described exemplary embodiments. A basic configuration and an operation of the image forming apparatus are similar to those of the publicly known tandem type image forming apparatus, so that a simple description thereof is made below.

In an image forming apparatus 10 of the present exemplary embodiment, image forming units (i.e., image forming stations) for forming an image of each color, i.e., magenta (M), cyan (C), yellow (Y), and black (K), are arranged side by side. The toner images on the photosensitive drums 1Y, 1M, 1C, and 1*k* formed by the respective image forming units are sequentially transferred by the respective primary transfer units to the intermediate transfer belt 2*e* that is moved to pass through in adjacent to the respective photosensitive drums.

Accordingly, the respective image forming units include the photosensitive drums 1Y, 1M, 1C, and 1*k* as an image carrier. Each of the photosensitive drums is rotatable in an arrow A direction. Around each of the photosensitive drums 1Y, 1M, 1C, and 1*k*, charging devices 7Y, 7M, 7C, and 7*k*, exposure devices 8Y, 8M, 8C, and 8*k*, development units 4Y, 4M, 4C, and 4*k*, cleaning members 9Y, 9M, 9C, and 9*k* are respectively arranged along a rotational direction of the photosensitive drums.

Below each of the photosensitive drums 1Y, 1M, 1C, and 1*k* in FIG. 12, the intermediate transfer belt 2*e* is arranged, and a primary transfer unit is formed at a portion where each of the photosensitive drums is opposed to the intermediate transfer belt 2*e*. Further, at positions between each of the photosensitive drums 1Y, 1M, 1C, and 1*k* and the intermediate transfer belt 2*e*, primary transfer rollers 11Y, 11M, 11C, and 11*k* are arranged, respectively. Furthermore, at a downstream side of the primary transfer unit in the toner image conveyance direction (i.e., in an arrow G direction) and around the intermediate transfer belt 2*e*, a secondary transfer roller 12 is arranged.

At a position opposite to the secondary transfer roller 12 across the intermediate transfer belt 2*e*, a secondary transfer counter roller 16 is arranged. The secondary transfer roller 12 and the secondary transfer counter roller 16 form a secondary transfer unit. The secondary transfer counter roller 16 is connected to a transfer bias application unit 14 in order to apply a secondary transfer bias onto the secondary transfer unit. At a downstream side of the secondary transfer unit and around the intermediate transfer belt 2*e*, the cleaning blade 5 is arranged so as to sliding-contact with the front surface of the intermediate transfer belt 2*e*. A material of the cleaning blade 5 is similar to those used in the above described exemplary embodiments.

In the above described image forming apparatus, conventionally known image forming processing is performed by each of the image forming units and toner images are sequentially transferred onto the intermediate transfer belt 2*e*. Therefore, a full color toner image is formed onto the intermediate transfer belt 2*e*. The full color toner image is transferred onto a recording material S at the secondary transfer unit. After transferring the full color toner image, the toner remaining on the front surface of the intermediate transfer belt 2*e* is removed by the cleaning blade 5. On the other hand, the recording material S onto which the toner image is transferred is conveyed to a fixing device (not shown) and the toner image is heat-fused onto the recording material S.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-264311 filed Nov. 19, 2009, which is hereby incorporated by reference herein in its entirety.

What is claimed is:

1. An image forming apparatus comprising:

an image carrier of which surface is formed with a toner image;

a belt member configured to have an elastic layer and carry the toner image formed on the image carrier;

a transfer unit configured to form a nip portion where the toner image on the image carrier is transferred onto the belt member; and a cleaning member configured to clean toner remaining on an outer surface of the belt member after the toner image formed on the outer surface of the belt member is transferred onto a transfer material, wherein a portion having a predetermined thickness from the outer surface of the belt member has an elastic modulus in a thickness direction smaller than an elastic modulus of the toner and an elastic modulus of the cleaning member, and an elastic modulus of the belt member in a rotational direction thereof is larger than an elastic modulus of the belt member in a width direction thereof.

2. The image forming apparatus according to claim 1, wherein the portion having the predetermined thickness from the outer surface of the belt member has an elastic modulus in the width direction of the belt member smaller than the elastic modulus of the toner.

3. The image forming apparatus according to claim 1, wherein the portion having the predetermined thickness from the outer surface of the belt member has an elastic modulus in the rotational direction of the belt member larger than the elastic modulus of the cleaning member.

4. The image forming apparatus according to claim 1, wherein the portion having the predetermined thickness from the outer surface of the belt member is formed such that more than two layers having different elastic moduli are laminated in the thickness direction and, among each of the layers, a top layer of the most outer surface side has an elastic modulus lager than that of the other layers, and a surface texture of the belt member has ten-point average roughness Rz larger than 0 and less than a volume average particle diameter of the toner.

5. The image forming apparatus according to claim 1, wherein a surface texture of the belt member has an average distance Sm of an unevenness of a surface roughness in the main-scanning direction smaller than the minimum pixel width of a toner image formed on the outer surface of the belt member.

6. The image forming apparatus according to claim 1, wherein the elastic layer of the belt member includes a fibrous form filler material along the rotational direction.

7. The image forming apparatus according to claim 6, wherein a distance between the fibrous form fillers in the main-scanning direction are smaller than a width of the cleaning member in a width direction thereof and larger than the minimum pixel width of the toner image formed on the outer surface of the belt member.

* * * * *